US011077703B2

(12) United States Patent
Araki et al.

(10) Patent No.: US 11,077,703 B2
(45) Date of Patent: Aug. 3, 2021

(54) COMMODITY RETRACTING DEVICE

(71) Applicant: ARAKI F MACHINE INC., Hyogo (JP)

(72) Inventors: Shinya Araki, Hyogo (JP); Akihito Kikawa, Hyogo (JP)

(73) Assignee: ARAKI F MACHINE INC., Hyogo (JP)

( * ) Notice: Subject to any disclaimer, the term of this patent is extended or adjusted under 35 U.S.C. 154(b) by 86 days.

(21) Appl. No.: 16/492,386

(22) PCT Filed: Mar. 7, 2017

(86) PCT No.: PCT/JP2017/009089
§ 371 (c)(1),
(2) Date: Sep. 9, 2019

(87) PCT Pub. No.: WO2018/163305
PCT Pub. Date: Sep. 13, 2018

(65) Prior Publication Data

US 2021/0078354 A1 Mar. 18, 2021

(51) Int. Cl.
*B43K 24/14* (2006.01)
*B26B 1/08* (2006.01)
(Continued)

(52) U.S. Cl.
CPC ..... *B43K 24/146* (2013.01); *B26B 1/08* (2013.01); *B43K 24/06* (2013.01); *B43K 25/028* (2013.01); *B43L 19/0068* (2013.01); *F21V 15/01* (2013.01)

(58) Field of Classification Search
CPC ..... B43K 24/06; B43K 24/146; B43K 24/02; B43K 24/10; B43K 25/028; B26B 1/08; B43L 19/0068; F21V 15/01
See application file for complete search history.

(56) References Cited

U.S. PATENT DOCUMENTS 2,583,142 A * 1/1952 Frentzel ..... B43K 24/08 401/106
2,896,577 A * 7/1959 Merryman ..... B43K 24/02 401/112
(Continued)

FOREIGN PATENT DOCUMENTS

EP 0162006 B1 6/1988
FR 2413224 A1 7/1979
(Continued)

OTHER PUBLICATIONS

International Search Report for PCT/JP2017/009089 dated May 23, 2017.
(Continued)

*Primary Examiner* — J C Jacyna
(74) *Attorney, Agent, or Firm* — Millen, White, Zelano & Branigan, P.C.; William Nixon

(57) ABSTRACT

A mechanism of a daily commodity ejecting and retracting device includes an operating portion provided to rotate around a center line vertical to an axis line of a shaft tube in relation to the shaft tube between a first rotation position and a second rotation position. A rod portion is coupled within the shaft tube to rotate around a first axis line and is coupled to the daily commodity to rotate around a second axis line which is parallel to the first axis line. An eccentric position of the first axis line is set so that the daily commodity is immersed into the shaft tube via the rod portion when the operating portion is rotated to the first rotation position, and the daily commodity protrudes out of a leading end port of the shaft tube via the rod portion when the operating portion is rotated to the second rotation position.

10 Claims, 9 Drawing Sheets

(51) Int. Cl.

| | |
|---|---|
| ***B43K 24/06*** | (2006.01) |
| ***B43K 25/02*** | (2006.01) |
| ***B43L 19/00*** | (2006.01) |
| *F21V 15/01* | (2006.01) |

(56) References Cited

U.S. PATENT DOCUMENTS

| | | | | |
|---|---|---|---|---|
| 2,988,054 | A * | 6/1961 | Yates | B43K 24/02 401/112 |
| 4,619,130 | A | 10/1986 | Buzzi | |
| 4,917,519 | A | 4/1990 | White et al. | |
| 5,651,626 | A * | 7/1997 | Chen | B43K 7/005 401/104 |
| 6,264,388 | B1 | 7/2001 | Wang et al. | |
| 2001/0028821 | A1* | 10/2001 | Lai | B43K 24/02 401/112 |
| 2003/0012593 | A1* | 1/2003 | DeLuca | B43K 24/084 401/112 |
| 2005/0063178 | A1* | 3/2005 | Huang | B43K 29/10 362/118 |

FOREIGN PATENT DOCUMENTS

| | | | |
|---|---|---|---|
| JP | 60239294 | A | 11/1985 |
| JP | S62-085478 | U | 5/1987 |
| JP | H03-114387 | U | 11/1991 |
| JP | H05-068689 | U | 9/1993 |

OTHER PUBLICATIONS

English Translation of JPH0568689, Publication Date: Sep. 17, 1993.

English Translation of JPS6285478, Publication Date: May 30, 1987.

English Translation of JPH03114387, Publication Date: Nov. 25, 1991.

English Abstract of FR2413224, Publication Date: Jul. 27, 1979.

* cited by examiner

COMMODITY RETRACTING DEVICE

TECHNICAL FIELD

The present invention relates to a daily commodity ejecting and retracting device.

BACKGROUND ART

For example, as an ejecting and retracting mechanism which ejects and retracts a writing body such as a ballpoint pen and a mechanical pencil in relation to a leading end port of a shaft tube accommodating the writing body in an inner portion thereof, there has been known a structure including an operating portion which can rotate around a center line vertical to an axis line of the shaft tube, and a motion converting portion which converts a rotary movement of the operating portion into a linear movement so as to linearly move the writing body in a direction of the axial line of the shaft tube (refer, for example, to Patent Literature 1).

The ejecting and retracting mechanism described in the Patent Literature 1 is provided with a rack which can rotate around a center line vertical to the axis line of the shaft tube, and a pinion which is arranged so as to extend in the direction of the axis line of the shaft tube at a position engaging with the rack, as the motion converting portion. The rack is coupled to an operating portion which rotates around a center line thereof, and a lower end portion of the pinion is connected to an upper end portion of the writing body. As a result, the pinion engaging with the rack moves in the direction of the axis line of the shaft tube by rotationally operating the rack in one direction with the operating portion, thereby protruding the writing body from the leading end port of the shaft tube.

CITATION LIST

Patent Literature

Patent Literature 1: Japanese Unexamined Utility Model Application Publication No. H05-68689

SUMMARY OF INVENTION

Technical Problem

However, in the ejecting and retracting mechanism described in the Patent Literature 1, it is necessary to arrange the pinion so as to protrude more greatly to a rear end side of the shaft tube than the rack serving as a rotating portion within the shaft tube, and secure a space for moving the pinion to the rear end side of the shaft tube. As a result, a dimension of the shaft tube in the direction of the axis line is elongated, and there has been a problem of lack of compact structure.

Therefore, an object of the present invention is to provide a daily commodity ejecting and retracting device having a new ejecting and retracting mechanism which can be made compact.

Solution to Problem (1) The present invention is a daily commodity ejecting and retracting device including a shaft tube, a daily commodity which is accommodated in the shaft tube, and an ejecting and retracting mechanism which ejects and retracts the daily commodity in relation to a leading end port of the shaft tube, wherein the ejecting and retracting mechanism includes an operating portion which is provided so as to be rotatable around a center line vertical to an axis line of the shaft tube in relation to the shaft tube between a first rotation position and a second rotation position, and a rod portion which is coupled in one end portion thereof to the operating portion so as to be rotatable around a first axis line which is eccentric from the center line, and is coupled in the other end portion thereof to the daily commodity so as to be rotatable around a second axis line which is parallel to the first axis line, and an eccentric position of the first axis line in relation to the center line is set in such a manner that the daily commodity comes to an immersed state where the daily commodity is immersed into the shaft tube via the rod portion when the operating portion is rotated in one direction to the first rotation position, and the daily commodity comes to a protruding state where the daily commodity protrudes out of a leading end port of the shaft tube via the rod portion when the operating portion is rotated in the other direction to the second rotation position.

According to the present invention, the daily commodity comes to the protruding state where the daily commodity protrudes out of the leading end port of the shaft tube via the rod portion, by rotating the operating portion in one direction to the first rotation position, and the daily commodity comes to the immersed state where the daily commodity is immersed into the shaft tube via the rod portion, by rotating the operating portion in the other direction to the second rotation position. Further, since the one end portion of the rod portion moves within the shaft tube in the state of being coupled to the operating portion during the rotating operation of the operating portion, the one end portion of the rod portion does not protrude more greatly to the rear end side of the shaft tube than the operating portion which serves as the rotating portion, and it is not necessary to secure a space for the rod portion movement in a rear end side of the operating portion. As a result, in comparison with the case where the conventional rack and pinion are used, the shaft tube can be structured compact in the direction of the axis line.

(2) In the daily commodity ejecting and retracting device, the operating portion is preferably formed into a circular shape, and an outer peripheral surface of the operating portion is preferably exposed at least over a rotation angle range from the first rotation position to the second rotation position, in a rear end portion of the shaft tube.

In this case, since the outer peripheral surface of the operating portion formed into the circular shape is exposed over the rotation angle range from the first rotation position to the second rotation position, it is possible to easily rotate the operating portion.

(3) In the daily commodity ejecting and retracting device, the rod portion preferably serves as a control member which comes into contact with the operating portion at the first rotation position so as to control the rotation of the operating portion in the one direction, and comes into contact with the operating portion at the second rotation position so as to control the rotation of the operating portion in the other direction.

In this case, since the control member is not necessarily provided separately, the number of parts can be reduced, and it is possible to achieve simplification of the structure.

(4) In the daily commodity ejecting and retracting device, the ejecting and retracting mechanism is preferably provided further with a biasing portion which biases the rod portion to a rear end portion side of the shaft tube, and the first axis line is preferably positioned closer to the other direction side than an imaginary straight line connecting the second axis line and the center line, at the second rotation position.

In this case, since the rod portion is pressed to the rear end portion side of the shaft tube based on a biasing force of the biasing portion when the operating portion is at the second rotation position, the operating portion is biased so as to rotate only in the other direction. However, since the rod portion comes into contact with the operating portion at the second rotation position, the rotation of the operating portion in the other direction is controlled. Therefore, even in the case where an external force moving the operating portion in a direction of making the operating portion be immersed into the shaft tube is applied to the daily commodity in the protruding state when the operating portion is at the second rotation position, the operating portion can be retained at the second rotation position. As a result, it is possible to prevent the daily commodity from being immersed into the shaft tube.

(5) In the daily commodity ejecting and retracting device, the rod portion preferably has a first rod portion which is coupled to the operating portion so as to be rotatable around the first axis line, and a second rod portion which is coupled to the daily commodity so as to be rotatable around the second axis line, and the first rod portion is preferably arranged offset to one side in the direction of the center line in relation to the second rod portion.

In this case, for example, in the case where a member coupling the first rod portion to the operating portion protrudes to the other side of the first rod portion in the direction of the center line, a whole of the daily commodity ejecting and retracting device can be structured compact in the direction of the center line by making the first rod portion offset to the one side in the direction of the center line.

(6) In the daily commodity ejecting and retracting device, the first rod portion is preferably coupled to the operating portion so as to be rotatable via a pin passing through in the direction of the first axis line, and both end portions of the pin in an axial direction are preferably supported to the operating portion.

In this case, since the pin coupling the first rod to the operating portion is a both-ends supported structure in which both end portions thereof in the axial direction are supported by the operating portion, the first rod portion can be rotatably coupled to the operating portion in a more stable state in comparison with a cantilever structure in which one end portion of the pin in the axial direction is supported to the operating portion. As a result, it is possible to achieve a long service life of the daily commodity ejecting and retracting device.

(7) In the daily commodity ejecting and retracting device, the operating portion is preferably supported to the shaft tube so as to be rotatable via a rolling bearing.

In this case, the operating portion can be smoothly rotated in relation to the shaft tube.

(8) The daily commodity ejecting and retracting device preferably includes further a clip which is movable in relation to the shaft tube in the direction of the center line between a retracted position where at least a partial outer surface is flush with an outer peripheral surface of the shaft tube, and a protruding position where the outer surface protrudes out of the outer peripheral surface of the shaft tube.

In this case, since at least a part of the clip can be retracted in the shaft tube, it is possible to structure a whole of the daily commodity ejecting and retracting device more compact in the direction of the center line.

(9) The daily commodity ejecting and retracting device preferably includes further an elastic member which is provided within the shaft tube, and biases the clip to the protruding position side.

In this case, it is possible to retain the clip at the protruding position by a biasing force of the elastic member.

(10) In the daily commodity ejecting and retracting device, the rod portion preferably has a first rod portion which is coupled to the operating portion so as to be rotatable around the first axis line, and a second rod portion which is coupled to the daily commodity so as to be rotatable around the second axis line, the first rod portion is preferably arranged offset to one side in the direction of the center line in relation to the second rod portion, and the elastic member is preferably arranged in the other side in the direction of the center line at a position corresponding to the first rod portion.

In this case, it is possible to widen a space which is formed in the other side of the first rod portion in the direction of the center line within the shaft tube, by making the first rod portion off to the one side in the direction of the center line. As a result, the kind of the elastic members which can be arranged in the space is increased, and it is possible to enhance a degree of freedom when selecting the kind of the elastic member.

(11) The daily commodity ejecting and retracting device preferably includes further a locking mechanism which locks the clip at the retracted position.

In this case, it is possible to prevent the clip from moving from the retracted position to the protruding position by means of the locking mechanism.

Advantageous Effects of Invention

According to the present invention, it is possible to make the daily commodity ejecting and retracting device compact.

DESCRIPTION OF EMBODIMENTS

A description will be given below of an embodiment according to the present invention with reference to the accompanying drawings.

[Overall Structure]

Figure 1:
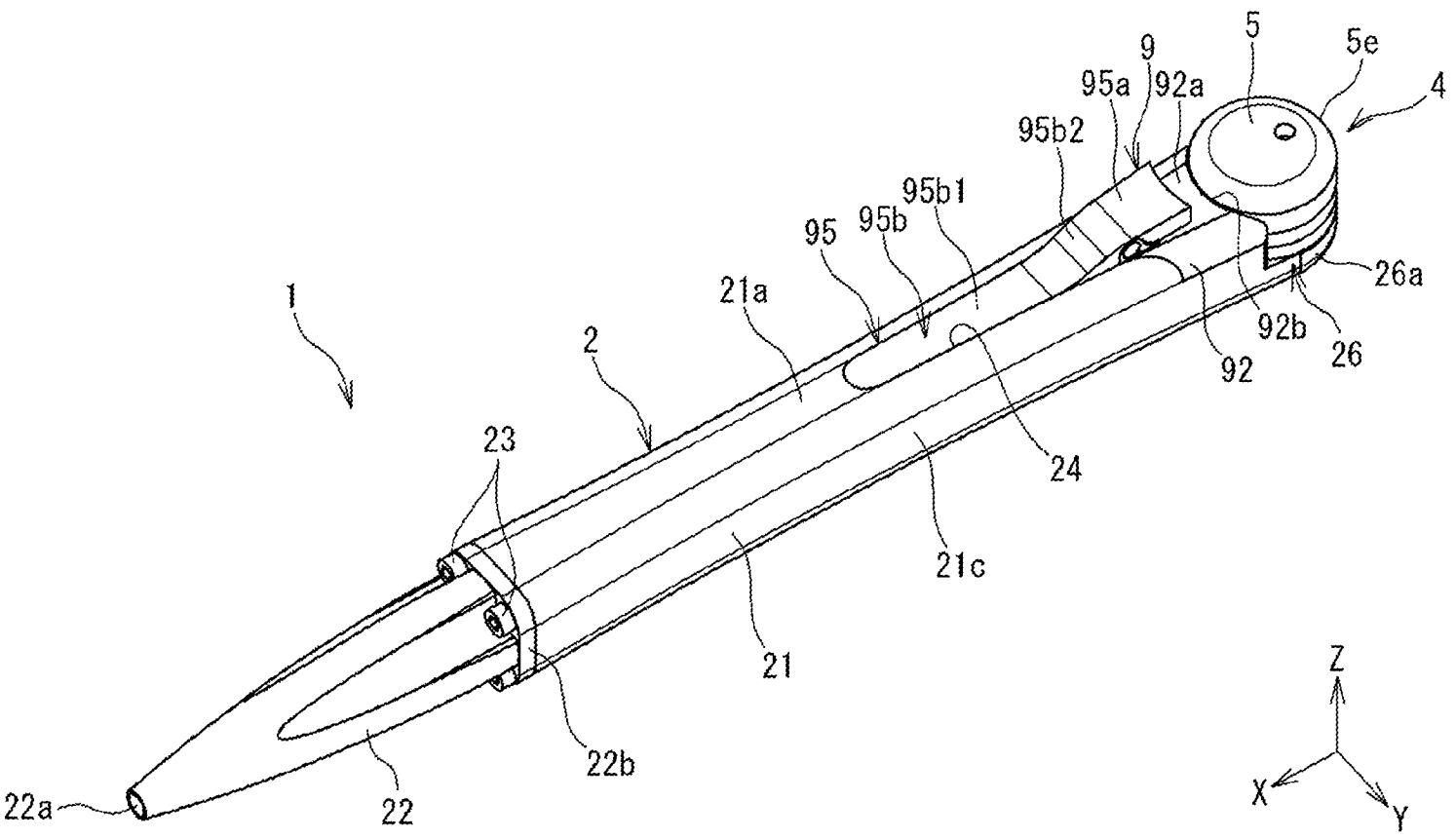
FIG. 1 is a perspective view of a daily commodity ejecting and retracting device according to an embodiment of the present invention.
Figure 2:
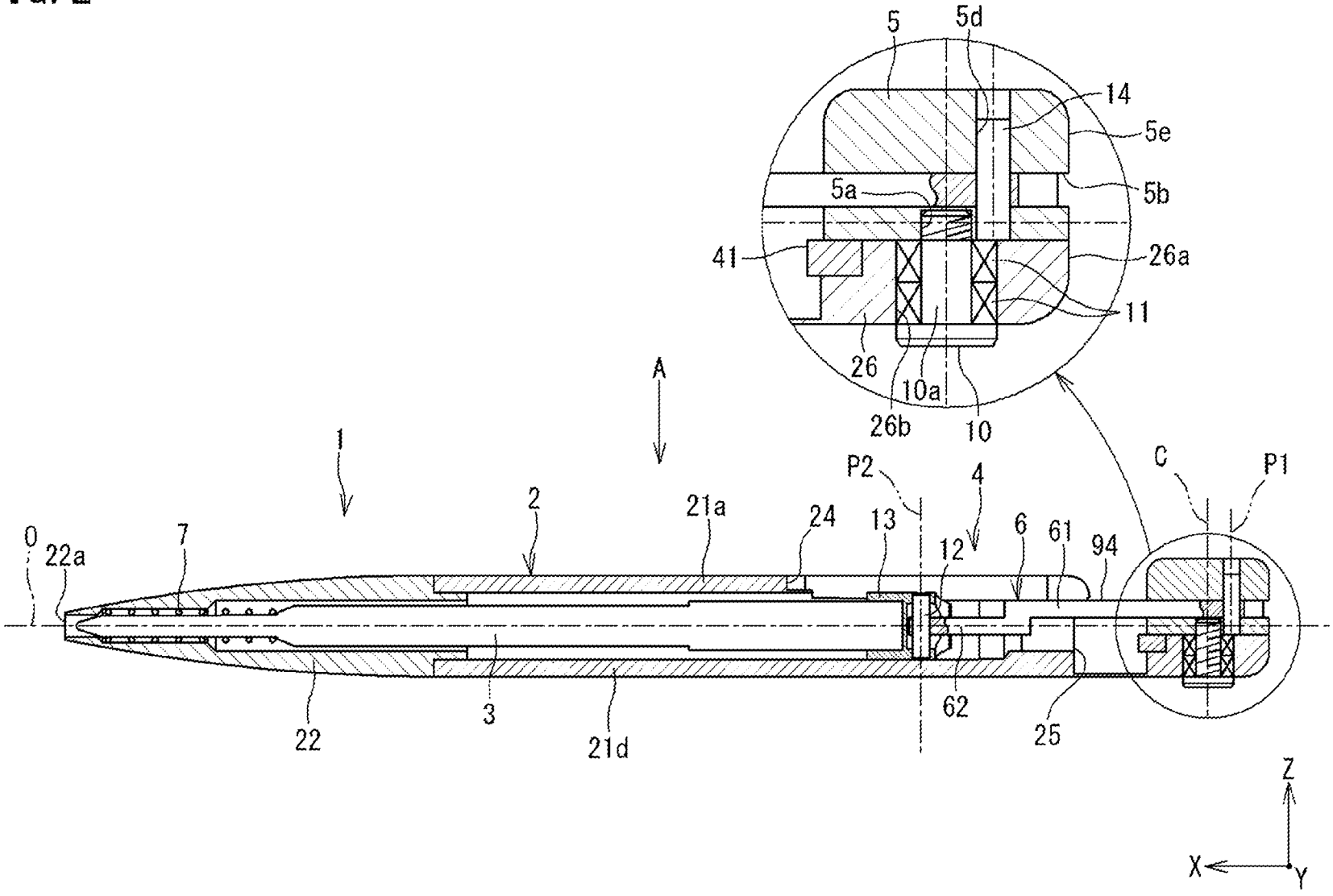
FIG. 2 is a cross sectional view of the daily commodity ejecting and retracting device.

FIG. 1 is a perspective view of a daily commodity ejecting and retracting device according to an embodiment of the present invention. Further, FIG. 2 is a cross sectional view of the daily commodity ejecting and retracting device. In FIGS. 1 and 2, the daily commodity ejecting and retracting device 1 according to the present embodiment is provided with a shaft tube 2, a writing body (a daily commodity) 3 such as a ballpoint pen or a mechanical pencil, which is accommodated within the shaft tube 2, an ejecting or retracting mechanism 4 which ejects and retracts the writing body 3 from or to a leading end port of the shaft tube 2, and a clip 9 which is attached to a rear end portion of the shaft tube 2.

In FIG. 2, an illustration of the clip 9 is omitted for convenience of description (same applied to FIG. 3 mentioned later). Further, in the present specification, a description will be given on the assumption that an X direction shown in FIG. 1 is a front-back direction, a Y direction is a horizontal direction, and a Z direction is a vertical direction.

[Shaft Tube]

The shaft tube 2 is provided with a tube main body portion 21, and a tube tip portion 22 which is attached to a leading end side of the tube main body portion 21. The tube main body portion 21 is constructed, for example, by a square tube body, and is formed into a round chamfered shape in four corner angled portions so as to be easily gripped when writing. An upper wall 21*a* of the tube main body portion 21 is provided with a notch groove 24 having a shape aligning with an outer shape of a flat portion 95*b*1 from a center portion toward a rear end portion thereof, for retracting the flat portion 95*b*1 of a clip main body 95 mentioned later into the tube main body portion 21 (refer also to FIG. 3).

Further, the tube main body portion 21 is formed an accommodation chamber 25 at a position which is adjacent to a rear end portion side of the notch groove 24 and in a lower side of a first rod portion 61 mentioned later, for accommodating guide portions 93 and 94 of a clip base body 91 mentioned later or the like. The accommodation chamber 25 is formed by cutting an upper wall 21*a* and being comparted by a right wall 21*b*, a left wall 21*c* and a lower wall 21*d* of the tube main body portion 21, and is formed into an approximately rectangular shape in a plan view.

Further, the lower wall 21*d* of the tube main body portion 21 is formed an attachment portion 26 to which a rotating knob 5 (mentioned later) is attached, at a position which is adjacent to a rear end portion side of the accommodation chamber 25. The attachment portion 26 is formed by cutting the other walls than the lower wall 21*d* of the tube main body portion 21, and a rear end surface 26*a* of the attachment portion 26 is formed into a circular arc shape.

The tube tip portion 22 is formed into a tapered shape from a rear end portion toward a leading end portion, and a leading end port 22*a* for ejecting and retracting the leading end portion of the writing body 3 is formed in the leading end portion. A flange portion 22*b*, for example, formed into a square shape is integrally formed in a rear end portion of the tube tip portion 22, and four corners of the flange portion 22*b* are detachably fixed to the tube main body portion 21 with bolts 23. As a result, it is possible to replace the writing body 3 within the shaft tube 2 with a new one by loosening each of the bolts 23 and detaching the tube tip portion 22 from the tube main body portion 21.

The writing body 3 is arranged concentrically with an axis line O of the shaft tube 2 within the shaft tube 2. The leading end portion of the writing body 3 is inserted into an elastic member 7, for example, constructed by a compression coil spring, and the writing body 3 is always biased in an immersed direction (a rearward direction) to the tube tip portion 22 based on a biasing force of the elastic member 7. The elastic member 7 according to the present embodiment serves as a biasing portion which biases a rod portion 6 mentioned later to a rear end portion side of the shaft tube 2. Since the writing body 3 is known, a description of a detail structure will be omitted.

[Ejecting and Retracting Mechanism]

Figure 3:
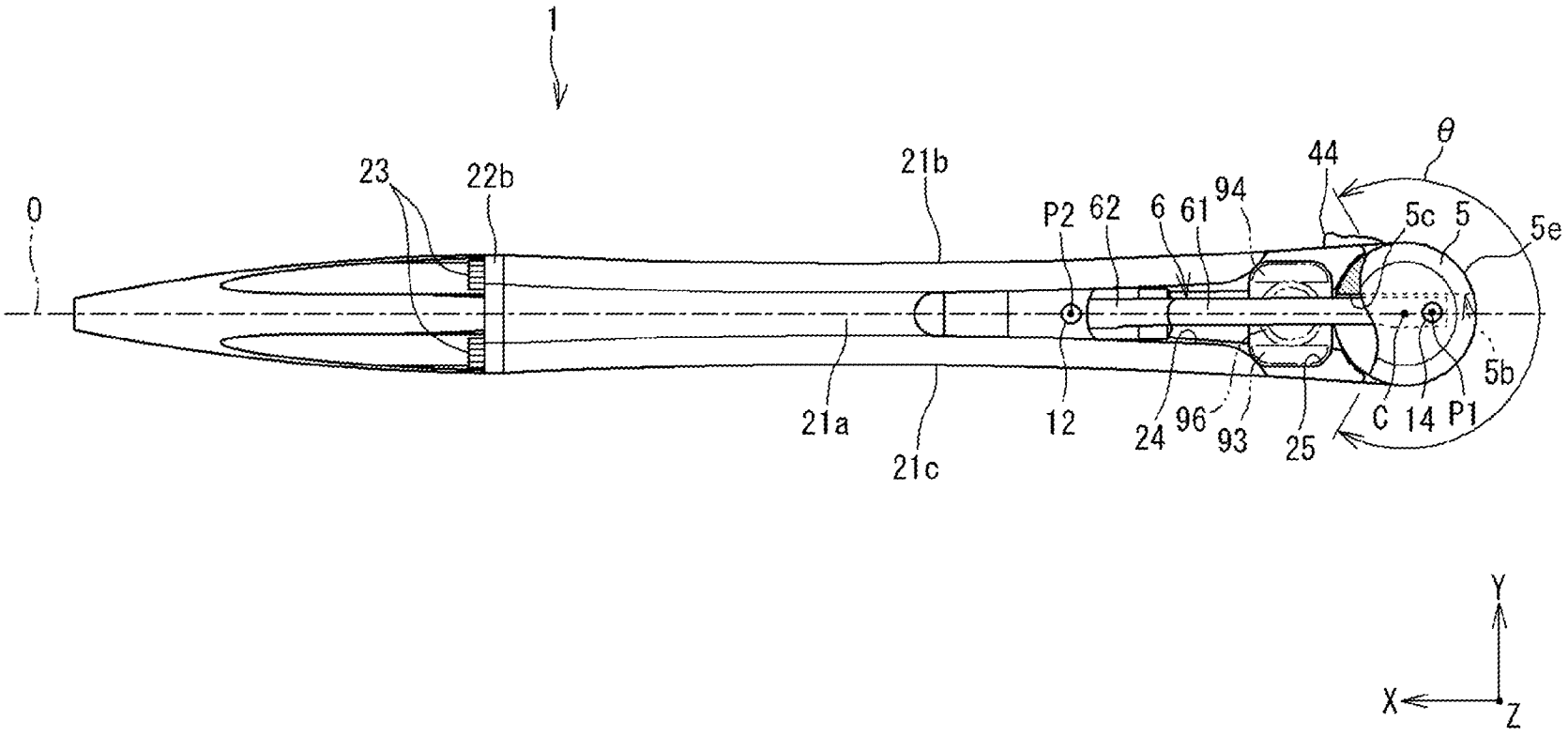
FIG. 3 is a view as seen from an arrow A in FIG. 2 and a plan view of the daily commodity ejecting and retracting device when a rotating knob is at a first rotation position.

FIG. 3 is a view as seen from an arrow A in FIG. 2. In FIGS. 2 and 3, the ejecting and retracting mechanism 4 is provided with a rotating knob (an operating portion) 5, a rod portion 6, and the elastic member 7. The rotating knob 5 is formed, for example, in to a circular shape, and is attached to a rear end portion of the tube main body portion 21 so as to be rotatable around a center line C which is vertical to the axis line O. More specifically, a through hole 26*b* passing through in a vertical direction is formed in an attachment portion 26 of the tube main body portion 21, and a shaft portion 10*a* of a bolt 10 passing through the through hole 26*b* from the below is threadably mounted with a bottomed threaded hole 5*a* which is formed in the center portion of the lower surface of the rotating knob 5.

The shaft portion 10*a* of the bolt 10 is attached so as to be rotatable in relation to the attachment portion 26 via a pair of upper and lower rolling bearings 11. As a result, the rotating knob 5 is supported so as to be rotatable in relation to the attachment portion 26 together with the bolt 10. The bolt 10 is rotatably supported by the rolling bearing 11, however, may be rotatably supported by the other bearing such as a slide bearing. Further, the bolt 10 is not necessarily supported by the bearing.

A depressed portion 5*b* is formed in a midstream portion of the rotating knob 5 in the vertical direction by being cut in a diametrical direction. The depressed portion 5*b* is formed by cutting a half or more of the rotating knob 5 in a plan view in FIG. 3, and is formed so as to be open at 180 degrees or more on an outer peripheral surface 5*e* of the rotating knob 5. A bottom surface 5*c* of the depressed portion 5*b* is formed into a linear shape in a plan view, and a width of the depressed portion 5*b* in the vertical direction is set to a dimension which is somewhat greater than a thickness of a first rod portion 61 mentioned later.

The rod portion 6 is structured such as to couple the rotating knob 5 and the writing body 3, and is arranged within the tube main body portion 21. The rod portion 6 has a first rod portion 61 which is coupled to the rotating knob 5 so as to be rotatable around a first axis line P1, and a second rod portion 62 which is coupled to the writing body 3 so as to be rotatable around a second axis line P2. The first axis line P1 and the second axis line P2 are parallel to the center line C. The first and second rod portions 61 and 62 are constructed by a rectangular parallelepiped flat member which is formed to extend straight in a front-back direction in a plan view.

The second rod portion 62 is arranged concentrically with an axis line O of the shaft tube 2, and the leading end portion of the second rod portion 62 is rotatably coupled to a rear end portion of the writing body 3 via a pin 12 and a tubular connection member 13. More specifically, the leading end portion of the connection member 13 is detachably fitted outward to the rear end portion of the writing body 3, and both end portions of the pin 12 passing through the leading end portion of the second rod portion 62 in a thickness direction thereof are fixed to the rear end portion of the connection member 13. As a result, the leading end portion of the second rod portion 62 is coupled to the pin 12 fixed to the writing body 3 side so as to be rotatable around the second axis line P2 corresponding to an axis line thereof.

The first rod portion 61 is arranged to be offset upward in relation to the second rod portion 62, and the leading end portion of the first rod portion 61 is integrally coupled to the rear end portion of the second rod portion 62. By offsetting the first rod portion 61 as mentioned above, the accommodation chamber 25 formed below the midstream portion of the first rod portion 61 can be wide in the vertical direction.

A rear end portion of the first rod portion 61 is rotatably coupled to the rotating knob 5 via a pin 14 in a state where it is inserted into the depressed portion 5*b* of the rotating knob 5. More specifically, in the rotating knob 5, a pin hole 5*d* is formed to pass through in the vertical direction so as to pass through the depressed portion 5*b*, at a position which is eccentric from the center line C in the plan view. Both end portions of the pin 14 passing through a rear end portion of the first rod 61 in a thickness direction are fixed to the pin hole 5*d* in a state where the rear end portion of the first rod portion 61 is inserted into the depressed portion 5*b*.

As a result, the rear end portion of the first rod portion 61 is coupled to the pin 14 fixed to the rotating knob 5 so as to be rotatable around the first axis line P1 corresponding to an axis line thereof. The pin 14 is formed as a both-ends supported structure in which both end portions thereof are supported to the rotating knob 5, however, may be formed as a cantilever structure in which only one end portion is supported to the rotating knob 5.

The rear end portion of the first rod portion 61 serves as a control member which controls rotation of the rotating knob 5 in one direction (a counterclockwise direction in FIG. 3, same applies to the below) by coming into contact with a bottom surface 5*c* of the depressed portion 5*b* when the rotating knob 5 is at a rotation position (a first rotation position) shown in FIG. 3.

Figure 4:
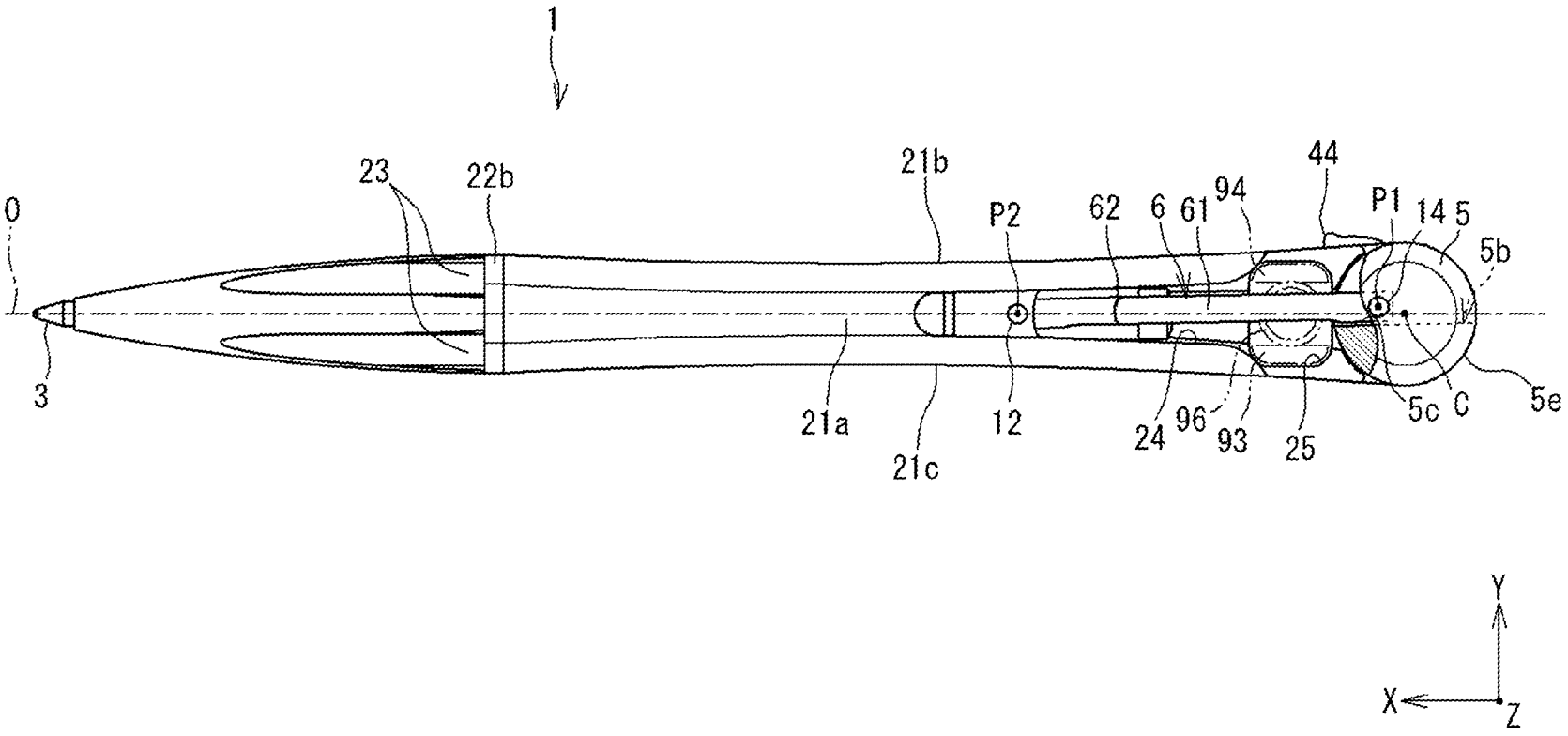
FIG. 4 is a plan view of the daily commodity ejecting and retracting device when the rotating knob is at a second rotation position.

Further, the rear end portion of the first rod portion 61 serves as a control member which controls rotation of the rotating knob 5 in the other direction by again coming into contact with the bottom surface 5*c* of the depressed portion 5*b* when the rotating knob 5 rotates from the first rotation position to the other direction (a clockwise direction in FIG. 3, same applied to the below) to a rotation position (a second rotation position) shown in FIG. 4. Therefore, the rotating knob 5 is structured such as to rotate in the one direction and the other direction in a rotation angle range (about 180 degrees in the present embodiment) from the first rotation position to the second rotation position.

The first rod portion 61 serves as the control member which controls the rotation of the rotating knob 5 in the one direction and the other direction. However, an exclusive control member for controlling the rotation of the rotating knob 5 in the one direction and the other direction may be separately provided. Further, the first rod portion 61 may serve as the control member which controls only the rotation of the rotating knob 5 in the one direction or the other direction. In this case, the rotation in the other direction or the one direction which cannot be controlled by the rotating knob 5 may be controlled by the exclusive control member.

As shown in FIG. 1, a part of an outer peripheral surface 5*e* of the rotating knob 5 is covered with a rear end surface 92*b* of the clip 9. Further, the other portion of the outer peripheral surface 5*e* of the rotating knob 5 is formed flush with a rear end surface 26*a* having a circular arc shape in an attachment portion 26 of the tube main body portion 21, and is exposed without being covered with the tube main body portion 21 and the clip 9. Therefore, as shown in FIG. 3, the outer peripheral surface 5*e* of the rotating knob 5 is exposed over an angle range θ (about 240 degrees) except the rear end surface of the clip 9, that is, beyond the rotation angle range (180 degrees). The outer peripheral surface 5*e* of the rotating knob 5 is preferably exposed at least over the rotation angle range, however, may be exposed less than the rotation angle range.

The first axis line P1 corresponding to a connecting point between the rod portion 6 and the rotating knob 5 is positioned in a rear side of the center line C when the rotating knob 5 is at the first rotation position (refer to FIG. 3). Further, the first axis line P1 is positioned in a front side of the center line C when the rotating knob 5 is at the second rotation position (refer to FIG. 4).

As a result, since the first axis line P1 moves in a forward direction by rotating the rotating knob 5 in the other direction from the first rotation position to the second rotation position, the rod portion 6 and the writing body 3 moves in the forward direction in conjunction therewith, so that the leading end portion of the writing body 3 comes to a protruding state where it protrudes out of the leading end port 22*a* of the tube tip portion 22.

On the other hand, since the first axis line P1 moves in a rearward direction by rotating the rotating knob 5 in the one direction from the second rotation position to the first rotation position, the rod portion 6 and the writing body 3 moves in the rearward direction in conjunction therewith, so that the leading end portion of the writing body 3 comes to an immersed state where it is immersed into the tube tip portion 22.

Therefore, the eccentric position of the first axis line P1 in relation to the center line C is set so that the leading end position of the writing body 3 comes to the protruding state via the rod portion 6 when the rotating knob 5 is rotated in the one direction to the first rotation position, and the leading end portion of the writing body 3 comes to the immersed state via the rod portion 6 when the rotating knob 5 is rotated in the other direction to the second rotation position.

As shown in FIG. 4, the first axis line P1 is positioned closer to the other direction side (the right side) than an imaginary straight line (an axis line O in the present embodiment) connecting the second axis line P2 and the center line C, when the rotating knob 5 is at the second rotation position. As a result, when the rotating knob 5 is at the second rotation position, the biasing force of the elastic member 7 (refer to FIG. 2) acts so as to move the rod portion 6 to the rear side via the writing body 3, so that the rotating knob 5 is biased so as to rotate only in the other direction.

However, the rotating knob 5 comes into contact with the first rod portion 61 at the second rotation position so as to be controlled the rotation in the other direction as mentioned above. Therefore, even in the case where the external force is applied to the writing body 3 in the protruding state so as to move the writing body 3 in the direction of immersing into the tube tip portion 22 when the rotating knob 5 is at the second rotation position, the rotating knob 5 can be retained at the second rotation position.

[Clip]

Figure 5:
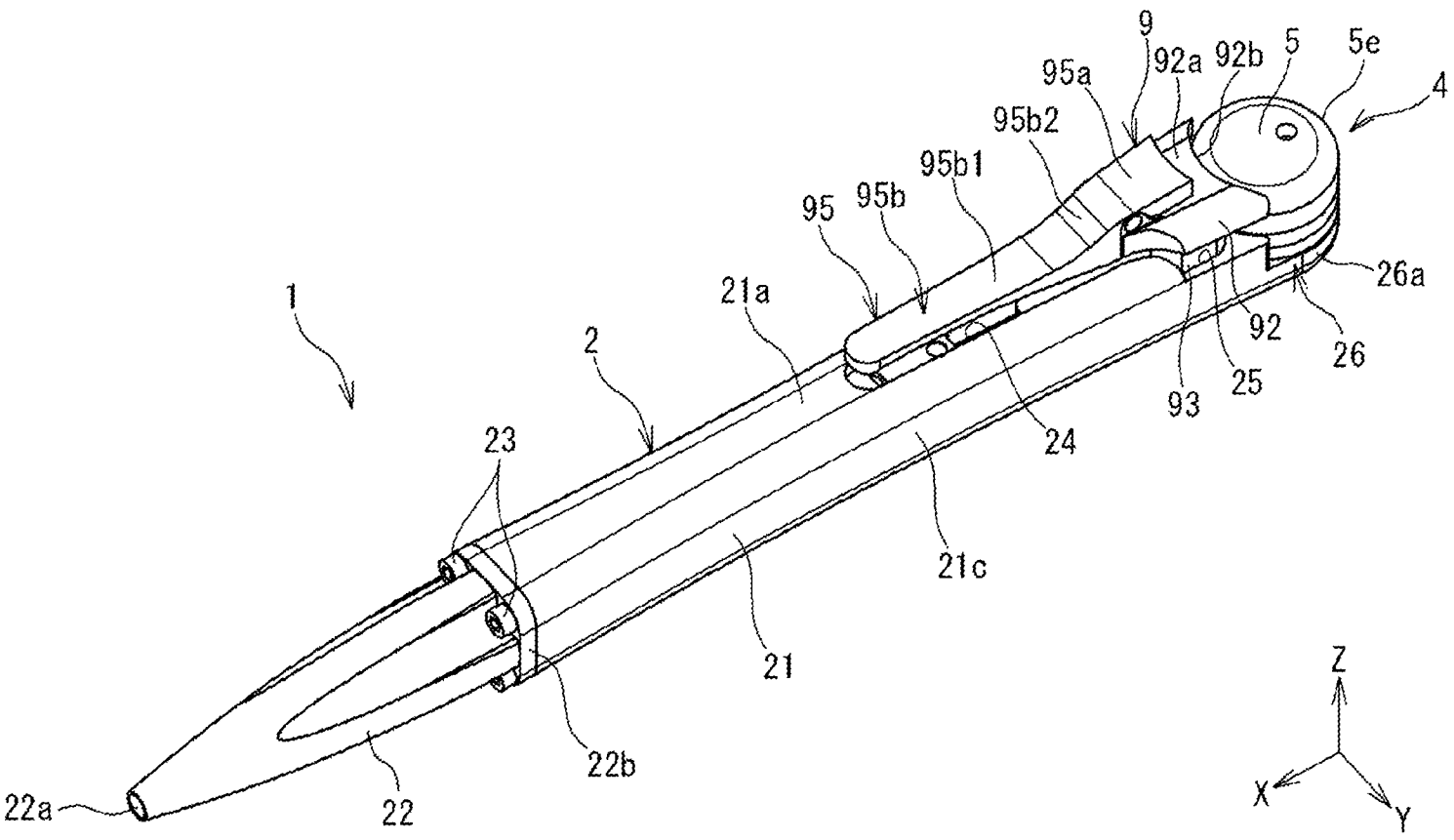
FIG. 5 is a perspective view of the daily commodity ejecting and retracting device and shows a used state of a clip.

FIG. 5 is a perspective view of the daily commodity ejecting and retracting device 1 and shows a used state of a clip 9. In FIGS. 1 and 5, the clip 9 is structured such as to clamp the daily commodity ejecting and retracting device 1, for example, in a breast pocket of clothes when carrying the daily commodity ejecting and retracting device 1. The clip 9 is attached to the tube main body portion 21 so as to be movable in a vertical direction between a retracted position (refer to FIG. 1) where the clip 9 is retracted in the tube main body portion 21, and a protruding position (refer to FIG. 5) where the clip 9 protrudes above the tube main body portion 21.

Figure 6:
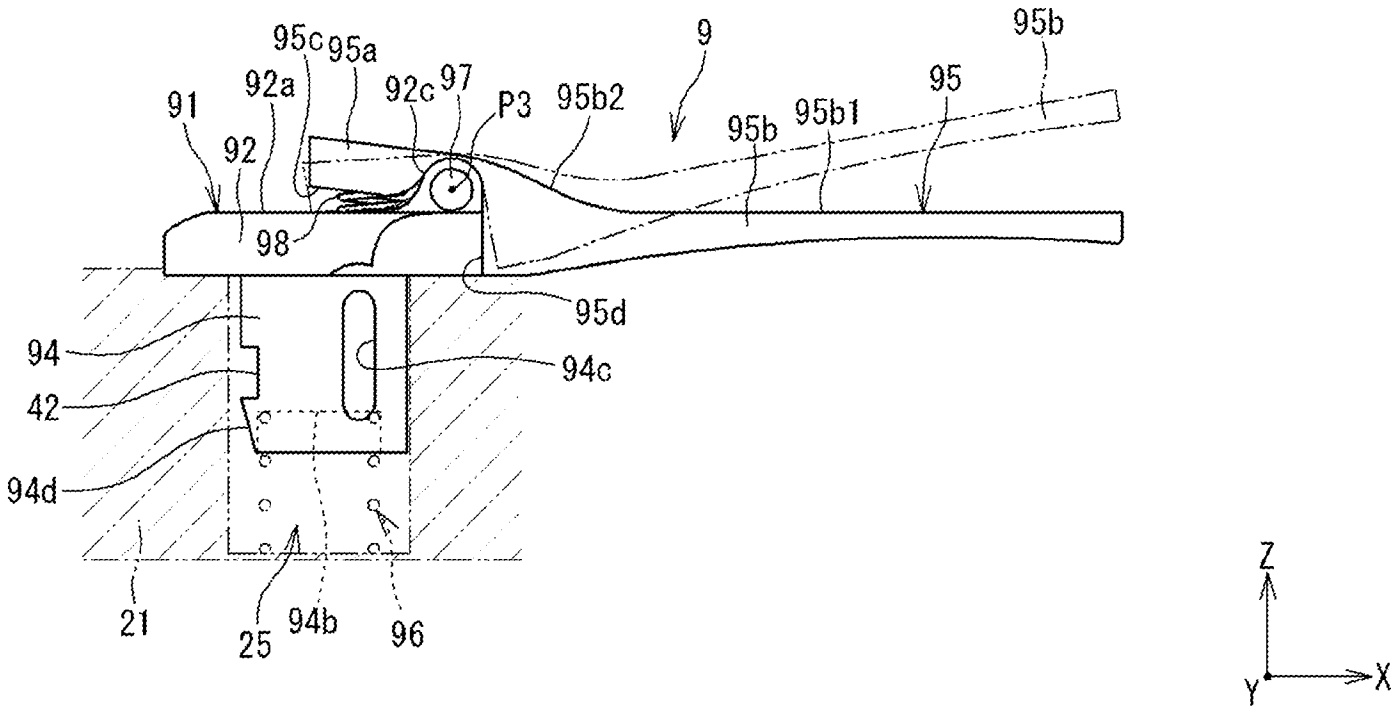
FIG. 6 is a side elevational view of the clip.
Figure 7:
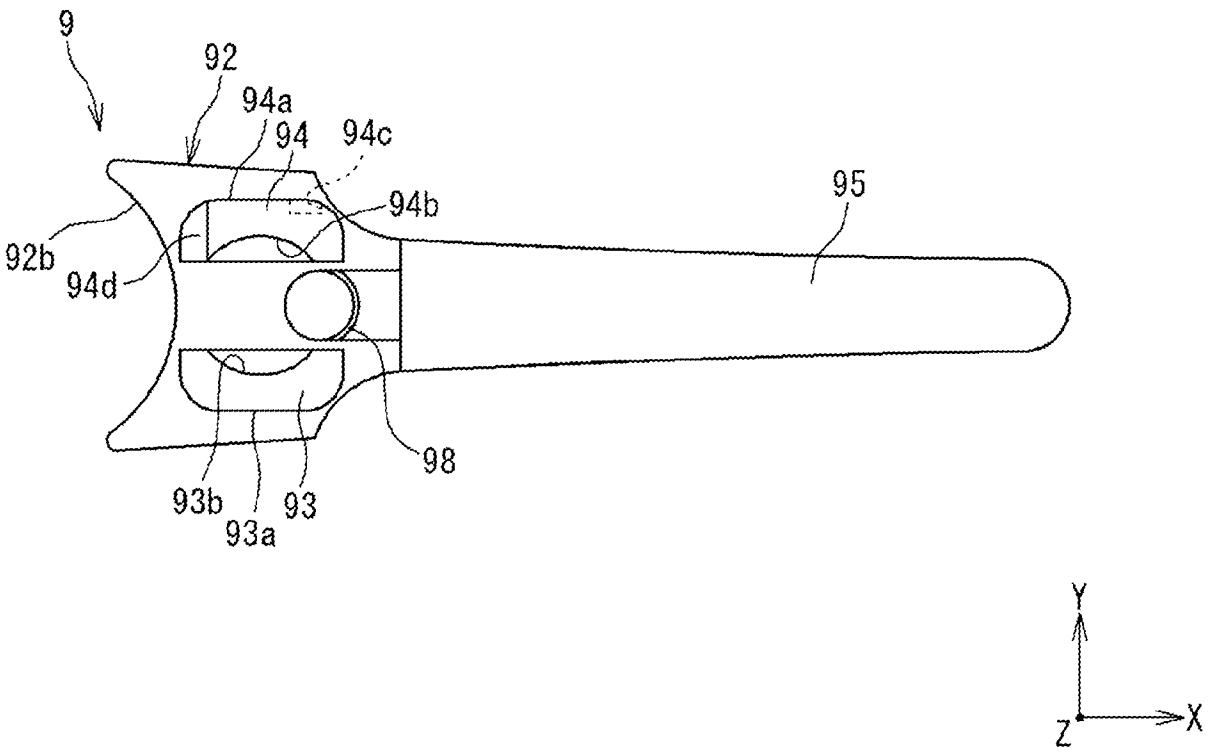
FIG. 7 is a plan view of the clip as seen from a rear side thereof.

FIG. 6 is a side elevational view of the clip 9. Further, FIG. 7 is a plan view of the clip 9 as seen from a rear side. In FIGS. 6 and 7, the clip 9 is provided with a clip base body 91, and a clip main body 95 which is provided so as to be rotatable in a vertical direction in relation to the clip base body 91. The clip base body 91 has a lid portion 92 and a pair of right and left guide portions 93 and 94 which protrude downward from a lower surface of the lid portion 92.

The lid portion 92 is constituted, for example, by a flat plate member, and is structured, for example, such as to cover an upper opening of the accommodation chamber 25 in the tube main body portion 21 at the retracted position, as shown in FIG. 1. Further, at the retracted position, an outer surface 92*a* (an upper surface and both right and left side surfaces) of the lid portion 92 is formed so as to be flush with an outer peripheral surface (each of outer surfaces of the upper wall 21*a*, the right wall 21*b* and the left wall 21*c*) of the tube main body portion 21. As shown in FIGS. 1 and 7, a rear end surface 92*b* of the lid portion 92 is formed into a concave circular arc shape along the outer peripheral surface 5*e* of the rotating knob 5. As a result, the lid portion 92 (except a bracket 92*c* mentioned later) comes to a state of being retracted in the tube main body portion 21 at the retracted position.

In FIGS. 6 and 7, the guide portions 93 and 94 are accommodated within the accommodation chamber 25 in a state of striding over the first rod portion 61 from the above of the accommodation chamber 25 in the tube main body portion 21 so as to be movable up and down (refer also to FIG. 3). Each of the outer surfaces 93*a* and 94*a* of the guide portions 93 and 94 is structured such as to move up and down while being guided by each of inner surfaces of the right wall 21*b* and the left wall 21*c* forming the accommodation chamber 25.

An elastic member 96 constructed by a compression coil spring is accommodated within the accommodation chamber 25 below both the guide portions 93 and 94. Engagement grooves 93*b* and 94*b* with which an upper end portion of the elastic member 96 is engaged are formed in lower surfaces of the guide portions 93 and 94. The engagement grooves 93*b* and 94*b* are formed into a circular arc shape along an outer shape of the elastic member 96 in a plan view. As a result, each of the guide portions 93 and 94 is always pressed upward by the biasing force of the elastic member 96. More specifically, the clip 9 is always biased to the protruding position side by the biasing force of the elastic member 96.

Figure 8:
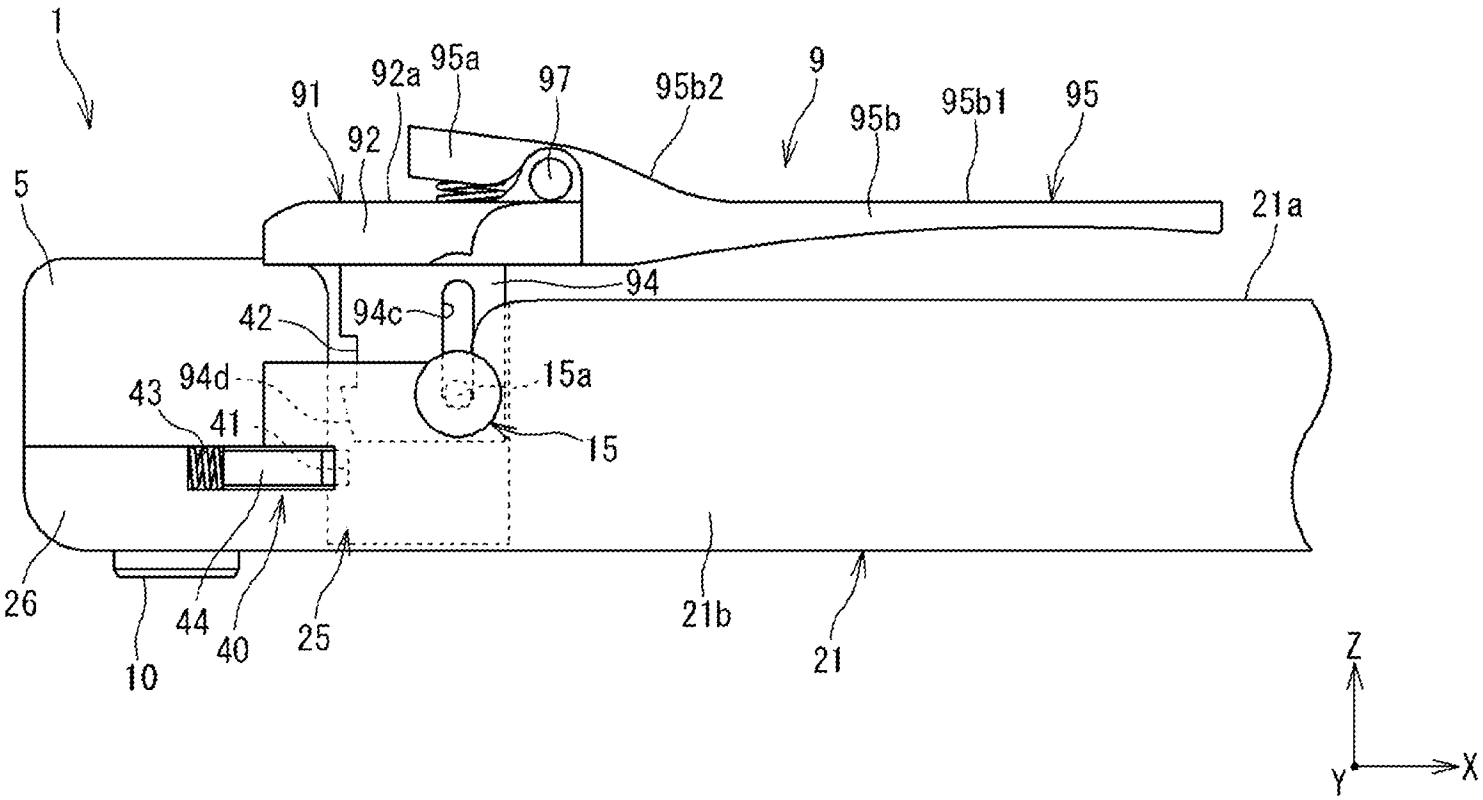
FIG. 8 is a side elevational view showing a rear end portion of the daily commodity ejecting and retracting device in a state where the clip is at a protruding position.

A bottomed elongate hole 94*c* extending in a vertical direction is formed on an outer surface of one guide portion 94. FIG. 8 is a side elevational view showing a rear end portion of the daily commodity ejecting and retracting device 1 in a state where the clip 9 is at the protruding position. In FIG. 8, an illustration of the elastic member 96 is omitted (same applies to FIG. 9). A shaft portion 15*a* of a bolt 15 threadably mounted with the right wall 21*b* of the tube main body portion 21 from an outer side and passing therethrough is inserted into the elongate hole 94*c* of the guide portion 94. By means of this bolt 15, the guide portion 94 is supported to the right wall 21*b* so as to be movable up and down in a length range of the elongate hole 94*c* in a vertical direction.

As mentioned above, the guide portions 93 and 94 are pressed upward in relation to the tube main body portion 21 by the biasing force of the elastic member 96 (refer to FIG. 6), and the lower end portion of the elongate hole 94*c* in the guide portion 94 accordingly comes into contact with the shaft portion 15*a* of the bolt 15, so that the clip 9 is retained at the protruding position. At the protruding position of the clip 9, the outer surface 92*a* of the lid portion 92 comes to a state where the outer surface 92*a* protrudes upward from an outer peripheral surface of the tube main body portion 21 (the outer surface of the upper wall 21*a*).

Figure 9:
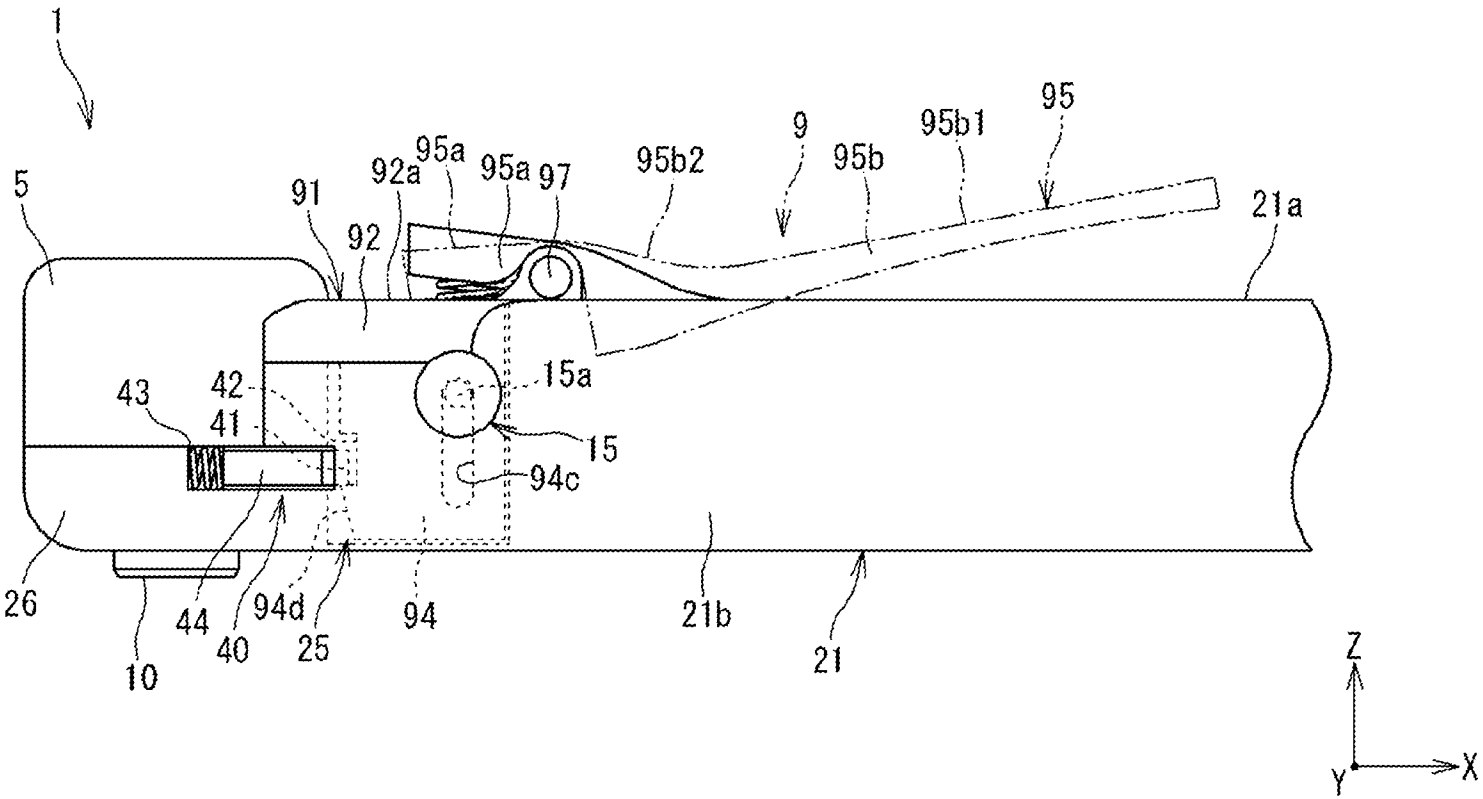
FIG. 9 is a side elevational view showing the rear end portion of the daily commodity ejecting and retracting device in a state where the clip is at a retracted position.

On the contrary, since the upper end portion of the elongate hole 94*c* of the guide portion 94 comes into contact with the shaft portion 15*a* of the bolt 15 as shown in FIG. 9 by pressing downward the guide portions 93 and 94 against the biasing force of the elastic member 96, the clip 9 is controlled to be moved downward from the retracted position. Further, the clip 9 is locked by a locking mechanism 40 mentioned later at the retracted position.

In FIGS. 6 and 7, a bracket 92*c* is integrally formed in a leading portion side in an upper surface of the lid portion 92, and a rear end portion of the clip main body 95 is rotatably attached to the bracket 92*c* so as to be rotatable via a pin 97 extending in a horizontal direction. As a result, the clip main body 95 is attached to the clip base body 91 so as to be rotatable around a third axis line P3 corresponding to an axis line of the pin 97.

The clip main body 95 has a pressing portion 95*a* which is formed closer to a rear end portion side than the third axis line P3, and a clamping portion 95*b* which is formed closer to a leading end side than the third axis line P3. An elastic member 98 constructed by a compression coil spring is attached between the pressing portion 95*a* and the lid portion 92, and the clip main body 95 is biased in a clockwise direction in FIG. 6 in relation to the clip base body 91 with a biasing force of the elastic member 98.

A lower surface of the pressing portion 95*a* is formed as a first contact surface 95*c* which comes into contact with an upper surface of the lid portion 92 when pressing the pressing portion 95*a* from the above. As a result, the first contact surface 95*c* controls the clip main body 95 rotating in a counterclockwise direction in FIG. 6 from an upward rotation position shown by a two-dot chain line in FIG. 6.

A second contact surface 95*d* coming into contact with a leading end surface of the lid portion 92 is formed in a rear end portion of the clamping portion 95*b*. As a result, the second contact surface 95*d* controls the clamping portion 95*b* rotating in a clockwise direction in FIG. 6 from a downward rotation position shown by a solid line in FIG. 6.

The clamping portion 95*b* has a flat portion 95*b*1 which is formed in an upper surface (an outer surface) thereof into a flat surface shape, and a curved portion 95*b*2 which is formed in an upper surface (an outer surface) thereof so as to protrude upward from the upper surface of the flat portion 95*b*1, in this order from the leading end portion side of the clamping portion 95*b*. As shown in FIG. 1, when the clip 9 is moved downward to the retracted position and the clamping portion 95*b* of the clip main body 95 is at the downward rotation position, the clamping portion 95*b* is formed so that the flat portion 95*b*1 is retracted within the notch groove 24, and the upper surface of the flat portion 95*b*1 is flush with the outer peripheral surface of the tube main body portion 21 (the outer surface of the upper wall 21*a*). Therefore, as shown in FIG. 5, when the clip 9 is moved upward to the protruding position in a state where the clamping portion 95*b* is at the downward rotation position, there comes to a state where a whole of the clamping portion 95*b* protrudes upward from the outer peripheral surface of the tube main body portion 21.

As mentioned above, as shown in FIG. 9, by pressing the pressing portion 95*a* of the clip main body 95 at the retracted position of the clip 9, the leading end portion of the clamping portion 95*b* in the clip main body 95 comes to an upward rotation position (a position indicated by a two-dot chain line in FIG. 9) which protrudes upward from the tube main body portion 21. In the case where the pressing of the pressing portion 95*a* is cancelled by inserting the clothing fabric in the breast pocket into a gap between the clamping portion 95*b* and the tube main body portion 21 in this state, the clamping portion 95*b* rotates to the downward rotation position side by the biasing force of the elastic member 98, thereby clamping the clothing fabric in the breast pocket between the clamping portion 95*b* and the tube main body portion 21. As a result, it is possible to clamp the ejecting and retracting device 1 in the breast pocket.

Further, for example, in the case where the clothing fabric in the breast pocket is thick, the clip 9 is moved upward to the protruding position in a state where the clamping portion 95*b* is at the downward rotation position, and a gap is formed between the clamping portion 95*b* and the tube main body portion 21, as shown in FIG. 8. In the case where the clothing fabric in the thicker breast pocket than the gap is inserted into the gap between the clamping portion 95*b* and the tube main body portion 21 in this state, the clamping portion 95*b* rotates to the upward rotation position side against the biasing force of the elastic member 98 by the clothing fabric, thereby clamping the clothing fabric in the breast pocket between the clamping portion 95*b* and the tube main body portion 21. As a result, even in the case where the clothing fabric in the breast pocket is thick, it is possible to clamp the ejecting and retracting device 1 in the breast pocket.

[Locking Mechanism]

In FIGS. 8 and 9, the daily commodity ejecting and retracting device 1 is further provided with a locking mechanism 40 which locks the clip 9 at the retracted position. The locking mechanism 40 is provided with an engagement convex portion 41, an engagement concave portion 42, an elastic member 43, and an operation claw 44. The engagement convex portion 41 is attached to the outer peripheral portion of the attachment portion 26 within the tube main body portion 21 so as to be movable in a front-back direction. The leading end portion of the engagement convex portion 41 comes to a state of protruding into the accommodation chamber 25 by moving in a forward direction (refer also to FIG. 2), and comes to a state of retracting from the accommodation chamber 25 by moving in a rearward direction.

The elastic member 43 is arranged within the attachment portion 26, and always biases the engagement convex portion 41 in the forward direction based on the biasing force. More specifically, the elastic member 43 always biases the engagement convex portion 41 based on the biasing force thereof so as to protrude into the accommodation chamber 25.

The engagement concave portion 42 is formed on a rear surface of the guide portion 94 in the clip 9, and is structured such that the engagement convex portion 41 engages with the engagement concave portion 42 when the clip 9 moves downward to the retracted position. A taper surface 94*d* is formed on the rear surface of the guide portion 94 below the engagement concave portion 42. The taper surface 94*d* is inclined so as to protrude in a rearward direction little by little from a lower end toward an upper end.

The operation claw 44 is integrally formed with the engagement convex portion 41, and protrudes outward from the right wall 21*b* of the tube main body portion 21 (refer to FIG. 3). When the operation claw 44 is moved in the rearward direction, the engagement convex portion 41 moves in the rearward direction against the biasing force of the elastic member 43.

As mentioned above, since the guide portions 93 and 94 move downward by pressing the clip 9 downward against the biasing force of the elastic member 96 (refer to FIG. 6) from a state shown in FIG. 8, the lower end of the taper surface 94*d* of the guide portion 94 comes into contact with the engagement convex portion 41 protruding into the accommodation chamber 25. Further, since the engagement convex portion 41 is pressed in the rearward direction little by little by the taper surface 94*d* by further pressing the clip 9 downward, the engagement convex portion 41 moves in the rearward direction little by little against the biasing force of the elastic member 43.

Further, as shown in FIG. 9, since the taper surface 94*d* moves to the downward side of the engagement convex portion 41 by pressing the clip 9 to the retracted position, and the engagement convex portion 41 is cancelled its contact with the taper surface 94*d*, the engagement convex portion 41 moves in the forward direction by the biasing force of the elastic member 43, and comes to a state where it engages with the engagement concave portion 42. As a result, since the engagement convex portion 41 is retained in a state where the engagement convex portion 41 engages with the engagement concave portion 42 by the biasing force of the elastic member 43, the upward movement of the guide portion 94 is controlled, and the clip 9 is locked at the retracted position.

In the case where the clip 9 is moved to the protruding position from the state shown in FIG. 9, the operation claw 44 is moved in the rearward direction, and the engagement convex portion 41 is moved in the rearward direction against the biasing force of the elastic member 43. As a result, since the engagement concave portion 42 of the guide portion 94 is cancelled its engagement with the engagement convex portion 41, the guide portions 93 and 94 move upward by the biasing force of the elastic member 96, and the clip 9 is retained at the protruding position by the biasing force of the elastic member 96, as shown in FIG. 8.

Operation and Effect

As mentioned above, according to the daily commodity ejecting and retracting device 1 of the present embodiment, the writing body 3 comes to the protruding state where the writing body 3 protrudes out of the leading end port 22*a* of the shaft tube 2 via the rod portion 6 by rotating the rotating knob 5 in one direction to the first rotation position, and the writing body 3 comes to the immersed state where the writing body 3 is immersed into the shaft tube 2 via the rod portion 6 by rotating the rotating knob 5 in the other direction to the second rotation position. Further, since one end portion of the rod portion 6 moves within the shaft tube 2 in the state where it is coupled to the rotating knob 5 during the rotating operation of the rotating knob 5, one end portion of the rod portion 6 does not protrude greatly to the rear end side of the shaft tube 2 from the rotating knob 5 serving as the rotating portion, and it is not necessary to secure any space for the movement of the rod portion 6 in the rear end side of the rotating knob 5. As a result, in comparison with the case where the conventional rack and pinion is used, the shaft tube 2 can be constructed more compact in the direction of the axis line O.

Further, since the outer peripheral surface 5*e* of the rotating knob 5 formed into the circular shape is exposed over the rotation angle range from the first rotation position to the second rotation position, it is possible to easily achieve the rotating operation of the rotating knob 5.

Further, the rod portion 6 serves as the control member which controls the rotation of the rotating knob 5 in one direction by coming into contact with the rotating knob 5 at the first rotation position, and controls the rotation of the rotating knob 5 in the other direction by coming into contact with the rotating knob 5 at the second rotation position. As a result, since it is not necessary to separately provide the control member, the number of parts is reduced, and it is possible to achieve a simple structure.

Further, the first axis line P1 in the one end portion of the rod portion 6 is positioned closer to the other direction side than the imaginary straight line connecting the second axis line P2 of the other end portion of the rod portion 6 and the center line C, at the second rotation position. As a result, since the rod portion 6 is pressed to the rear end portion side of the shaft tube 2 by the biasing force of the elastic member 7 when the rotating knob 5 is at the second rotation position, the rotating knob 5 is biased so as to rotate only in the other direction. However, since the rod portion 6 comes into contact with the rotating knob 5 at the second rotation position, the rotation of the rotating knob 5 in the other direction is controlled. Therefore, even in the case where the external force is applies so as to move the leading end portion of the writing body 3 in the immersing direction when the rotating knob 5 is at the second rotation position, the rotating knob 5 is retained at the second rotation position by the biasing force of the elastic member 7 and the first rod portion 61. As a result, it is possible to prevent the leading end portion of the writing body 3 from being immersed into the tube tip portion 22 when writing while pressing the leading end portion of the writing body 3 onto the paper.

Further, since the first rod portion 61 is arranged to be offset to the upper side in relation to the second rod portion 62, it is possible to construct the whole of the daily commodity ejecting and retracting device 1 compact in the vertical direction even in the case where the pin 14 connecting the first rod portion 61 to the rotating knob 5 is protruded downward from the first rod portion 61 so as to form the both-ends supported structure.

Further, since the pin 14 connecting the first rod portion 61 to the rotating knob 5 is formed as the both-ends supported structure in which both end portions in the axial direction are supported by the rotating knob 5, the first rod portion 61 can be rotatably coupled to the rotating knob 5 in a stable state in comparison with the case where the one end portion of the pin 14 in the axial direction is supported to the rotating knob 5 so as to form the cantilever structure. As a result, it is possible to achieve a long service life of the daily commodity ejecting and retracting device 1.

Further, since the rotating knob 5 is supported to the shaft tube 2 so as to be rotatable via the rolling bearing 11, it is possible to smoothly rotate the rotating knob 5 in relation to the shaft tube 2.

Further, the clip 9 is provided so as to be movable in the vertical direction in relation to be shaft tube 2 between the retracted position where the outer surface of the part (the lip portion 92 (except the bracket 92*c*) and the flat portion 95*b*1) is flush with the outer peripheral surface of the shaft tube 2, and the protruding position where the outer surface of the part protrudes from the outer peripheral surface of the shaft tube 2. In this case, since the part of the clip 9 can be retracted in the shaft tube 2, it is possible to construct the whole of the daily commodity ejecting and retracting device 1 further compact in the vertical direction.

Further, since the clip 9 is biased to the protruding position side by the elastic member 96, it is possible to retain the clip 9 at the protruding position.

Further, since the elastic member 96 is arranged in the opposite side (the lower side) to the offset direction (the upper side) of the first rod portion 61 at the position corresponding to the first rod portion 61, the following operation and effect can be achieved. It is possible to make the accommodation chamber 25 formed in the lower side of the first rod portion 61 within the shaft tube 2 wider by offsetting the first rod portion 61 to the upper side. As a result, the kind of the elastic member 96 which can be arranged in the accommodation chamber 25 is increased, thereby enhancing a degree of freedom when selecting the kind of the elastic member 96.

Further, since the clip 9 is locked at the retracted position by the locking mechanism 40, it is possible to prevent the clip 9 from moving from the retracted position to the protruding position.

[Other]

The embodiment disclosed as mentioned above is only an exemplification in all the points and is not a restricted one. More specifically, the daily commodity ejecting and retracting device according to the present invention is not limited to the illustrated embodiment, but may be structured as the other aspects within the scope of the present invention. For example, the daily commodity ejecting and retracting device according to the present invention employs the writing body as the daily commodity, however, can be applied to the other daily commodities such as an eraser, a pen light and a knife.

Further, the operating portion may be formed into any shape without being limited to the circular shape. Further, the elastic member biasing the writing body in the immersing direction serves as the biasing portion which biases the rod portion to the rear end portion side of the shaft tube, however, an exclusive biasing portion may be provided. Further, the ejecting and retracting mechanism is not necessarily provided with the biasing portion.

Further, the midstream portion of the rod portion is offset in the direction of the center line (the vertical direction), however, is not necessarily offset. Further, the clip is provided so as to be movable in relation to the shaft tube between the retracted position and the protruding position, however, may be fixed to the shaft tube at the protruding position. Further, the daily commodity ejecting and retracting device is not necessarily provided with the clip.

REFERENCE SIGNS LIST

1: DAILY COMMODITY EJECTING AND RETRACTING DEVICE
2: SHAFT TUBE
3: WRITING BODY (DAILY COMMODITY)
4: EJECTING AND RETRACTING MECHANISM
5: ROTATING KNOB (OPERATING PORTION)
5*a*: THREADED HOLE
5*b*: DEPRESSED PORTION
5*c*: BOTTOM SURFACE
5*d*: PIN HOLE
5*e*: OUTER PERIPHERAL SURFACE
6: ROD PORTION
7: ELASTIC MEMBER (BIASING PORTION)
9: CLIP
10: BOLT
10*a*: SHAFT PORTION

11: ROLLING BEARING
12: PIN
13: CONNECTION MEMBER
14: PIN
15: BOLT
15*a*: SHAFT PORTION
21: TUBE MAIN BODY PORTION
21*a*: UPPER WALL
21*b*: RIGHT WALL
21*c*: LEFT WALL
21*d*: LOWER WALL
22: TUBE TIP PORTION
22*a*: LEADING END PORT
22*b*: FLANGE PORTION
23: BOLT
24: NOTCH GROOVE
25: ACCOMMODATION CHAMBER
26: ATTACHMENT PORTION
26*a*: REAR END SURFACE
26*b*: THROUGH HOLE
40: LOCKING MECHANISM
41: ENGAGEMENT CONVEX PORTION
42: ENGAGEMENT CONCAVE PORTION
43: ELASTIC MEMBER
44: OPERATION CLAW
61: FIRST ROD PORTION
62: SECOND ROD PORTION
91: CLIP BASE BODY
92: LID PORTION
92*a*: OUTER SURFACE
92*b*: REAR END SURFACE
92*c*: BRACKET
93: GUIDE PORTION
93*a*: OUTER SURFACE
93*b*: ENGAGEMENT GROOVE
94: GUIDE PORTION
94*a*: OUTER SURFACE
94*b*: ENGAGEMENT GROOVE
94*c*: ELONGATE HOLE
94*d*: TAPER SURFACE
95: CLIP MAIN BODY
95*a*: PRESSING PORTION
95*b*: CLAMPING PORTION
95*b*1 FLAT PORTION
95*b*2: CURVED PORTION
95*c*: FIRST CONTACT SURFACE
95*d*: SECOND CONTACT SURFACE
96: ELASTIC MEMBER
97: PIN
98: ELASTIC MEMBER
C: CENTER LINE
0: AXIS LINE
P1: FIRST AXIS LINE
P2: SECOND AXIS LINE
P3: THIRD AXIS LINE

The invention claimed is:

1. A commodity ejecting and retracting device comprising:

a shaft tube;

a commodity which is accommodated in the shaft tube; and an ejecting and retracting mechanism which ejects and retracts the commodity in relation to a leading end port of the shaft tube, wherein the ejecting and retracting mechanism includes:

an operating portion which is provided so as to be rotatable around a center line vertical to an axis line of the shaft tube in relation to the shaft tube between a first rotation position and a second rotation position; and a rod portion which is coupled in one end portion thereof to the operating portion so as to be rotatable around a first axis line which is eccentric from the center line, and is coupled in the other end portion thereof to the commodity via a connection member so as to be rotatable around a second axis line which is parallel to the first axis line, and wherein an eccentric position of the first axis line in relation to the center line is set in such a manner that the commodity comes to an immersed state where the commodity is immersed into the shaft tube via the rod portion when the operating portion is rotated in one direction to the first rotation position, and the commodity comes to a protruding state where the commodity protrudes out of the leading end port of the shaft tube via the rod portion when the operating portion is rotated in the other direction to the second rotation position, the rod portion has a first rod portion which is coupled to the operating portion so as to be rotatable around the first axis line, and a second rod portion which is coupled to the connection member so as to be rotatable around the second axis line, and the first rod portion is arranged offset to one side in the direction of the center line in relation to the second rod portion.

2. The commodity ejecting and retracting device according to claim 1, wherein the operating portion is formed into a circular shape, and an outer peripheral surface of the operating portion is exposed at least over a rotation angle range from the first rotation position to the second rotation position, in a rear end portion of the shaft tube.

3. The commodity ejecting and retracting device according to claim 1, wherein the rod portion serves as a control member which comes into contact with the operating portion at the first rotation position so as to control the rotation of the operating portion in the one direction, and comes into contact with the operating portion at the second rotation position so as to control the rotation of the operating portion in the other direction.

4. The commodity ejecting and retracting device according to claim 3, wherein the ejecting and retracting mechanism further includes a biasing portion which biases the rod portion to a rear end portion side of the shaft tube, and the first axis line is positioned closer to the other direction side than an imaginary straight line connecting the second axis line and the center line, at the second rotation position.

5. The commodity ejecting and retracting device according to claim 1, wherein the first rod portion is coupled to the operating portion so as to be rotatable via a pin passing through in the direction of the first axis line, and both end portions of the pin in an axial direction are supported to the operating portion.

6. The commodity ejecting and retracting device according to claim 1, wherein the operating portion is supported to the shaft tube so as to be rotatable via a rolling bearing.

7. The commodity ejecting and retracting device according to claim 1 further comprising a clip which is movable in relation to the shaft tube in the direction of the center line between a retracted position where at least a partial outer surface is flush with an outer peripheral surface of the shaft tube, and a protruding position where the outer surface protrudes out of the outer peripheral surface of the shaft tube.

8. The commodity ejecting and retracting device according to claim 7, further comprising an elastic member which is provided within the shaft tube, and biases the clip to the protruding position side.

9. The commodity ejecting and retracting device according to claim 8, wherein the elastic member is arranged in the other side in the direction of the center line at a position corresponding to the first rod portion.

10. The commodity ejecting and retracting device according to claim 7, further comprising a locking mechanism which locks the clip at the retracted position.

* * * * *